United States Patent [19]

Mallouf

[11] 4,205,693

[45] Jun. 3, 1980

[54] WIG

[76] Inventor: Gene Mallouf, P.O. Box 205, Mangum, Okla. 73554

[21] Appl. No.: 10,046

[22] Filed: Feb. 6, 1979

[51] Int. Cl.[2] ..... A41G 3/00

[52] U.S. Cl. ..... 132/53

[58] Field of Search ..... 132/53, 54, 5

[56] References Cited

U.S. PATENT DOCUMENTS

| | | | |
|---|---|---|---|
| 2,602,460 | 7/1952 | Hull | 132/53 |
| 2,604,104 | 7/1952 | Perlin | 132/53 |
| 3,444,865 | 5/1969 | De Vita | 132/53 |
| 3,470,889 | 10/1969 | Webb | 132/53 |
| 3,868,959 | 3/1975 | Koh | 132/53 |

*Primary Examiner*—G. E. McNeill

*Attorney, Agent, or Firm*—D. Paul Weaver

[57] ABSTRACT

An interior skull cap formed of rubber snugly fits the scalp and forms a foundation for a separately formed exterior rubber cap having multiple apertures through which strands of hair project outwardly to present a very natural appearance. The interior cap contains rows of loops or half rings to which the hair strands are firmly anchored. Ventilating apertures at the opposite sides of each row of loops communicate with shallow ventilating channels on the interior cap below the rows of loops. Variable hair styling and tapering hair lines can be provided by means of the invention. The wig can be combed or brushed and will resist displacement in high wind, in the shower and even while swimming.

7 Claims, 8 Drawing Figures

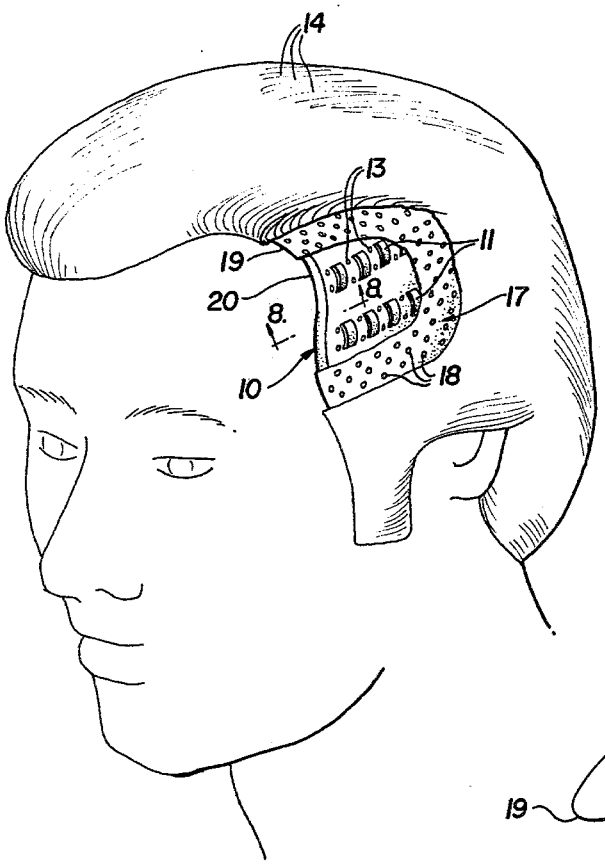
FIG.1
FIG.2
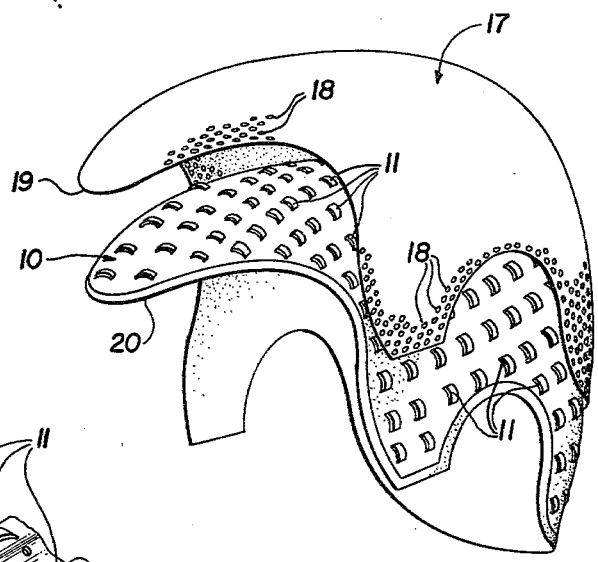
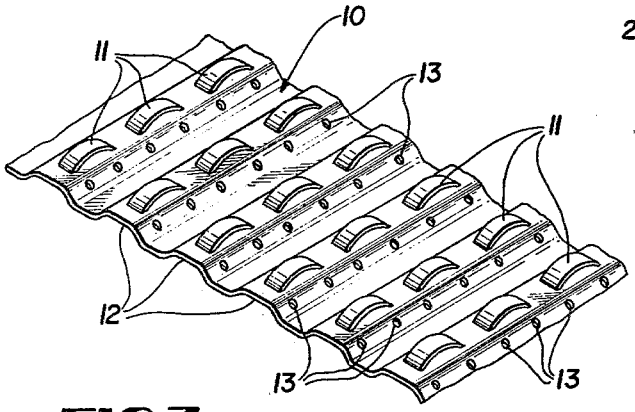
FIG.3
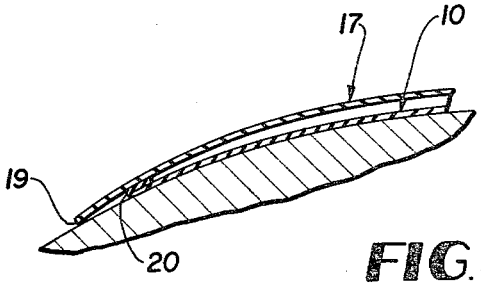
FIG.8

WIG

BACKGROUND OF THE INVENTION

The objective of this invention is to provide a more natural looking wig for bald persons which is very secure on the head and provides hair which may be styled to meet the wishes of the wearer while providing a tapering hair line having a fine line natural appearance.

Another objective is to provide a wig which will cling to the head in high winds, in the tub or shower, and even while swimming. The wig will allow vigorous brushing and combing of the hair without displacement from the scalp.

Still another object of the invention is to provide in a rubber wig means for adequately ventilating the scalp while the wig is in place.

Other objects and advantages of the invention will become apparent during the course of the following detailed description.

The prior art contains many teachings relative to wigs including some which employ an inner skull cap over which an outer cap is placed. Examples of such prior art devices are shown in U.S. Pat. Nos. 2,602,460; 3,474,767 and 3,809,100, made of record herein under 37 C.F.R. 1.56. The present invention differs notably from these prior art patents in the manner of attaching strands of hair to loops of the interior rubber skull cap, the particular ventilating means for the latter and the manner in which the hair strands are extended through provided apertures in the exterior cap.

BRIEF DESCRIPTION OF THE DRAWINGS

FIG. 1 is a perspective view of the invention in use, parts broken away.

FIG. 2 is an exploded perspective view of interior and exterior caps employed in the invention.

FIG. 3 is a fragmentary perspective view of the interior cap.

FIG. 8 is an enlarged fragmentary section taken on line 8—8 of FIG. 1.

DETAILED DESCRIPTION

Figure 4:
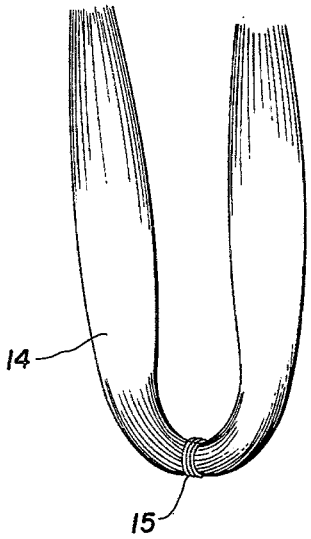
FIG. 4 is a perspective view of a hair strand prior to attachment to the wig.

Referring to the drawings in detail wherein like numerals designate like parts, an interior skull cap 10 of rubber or rubber-like material is adapted to snugly engage the scalp of the user and to resist displacement on the head in much the same manner as a swimmer's cap. The marginal edge of the cap 10 can be contoured in various ways to provide different styles of hair lines and the particular shape depicted in the drawings is simply one illustration of a hair line style. The cap 10 has a relatively thin wall and is quite flexible.

Disposed on the exterior surface of the cap 10, which is molded to the shape of a human skull, and preferably integral therewith, are multiple rows of hair strand attaching loops or half rings 11, which collectively cover the major portion of the exterior surface of the cap 10. The rows of loops 11 are closely spaced and the rows are defined both longitudinally of the head and across the head, as best shown in FIG. 2. The loops 11 are longitudinally disposed across or transversely of the head, although they could, if desired, be formed from front-to-back on the head.

Figure 5:
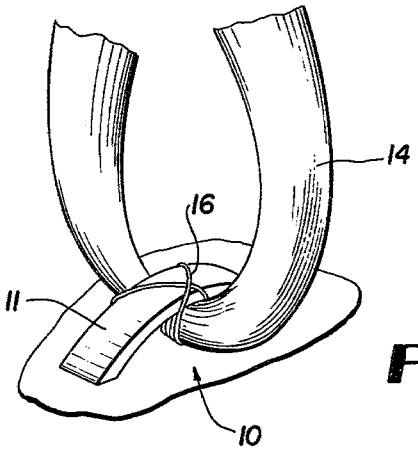
FIG. 5 is a perspective view of the hair strand after attachment to the interior cap.

Beneath each row of loops 11 transversely of the head is a downwardly open scalp ventilating channel 12 of shallow depth and the inclined side walls of each channel have multiple spaced ventilating apertures 13 formed therethrough, which apertures communicate directly with the channels 12. The channels 12 are deep enough to allow free circulation of air over the scalp while the wig is being worn. The channels 12 are continuous from one margin of the wig to the opposite margin. A multiplicity of prepared hair strands or sections 14 are suitably tied at 15, FIG. 4, midway between their ends. Each strand 14 is then passed beneath one of the attaching loops 11, FIG. 5, and then tied by a tying element 16 to the loop or half ring 11 so as to be firmly fixed thereto. Each loop 11 receives one of the prepared strands 14 in this manner.

Figure 6:
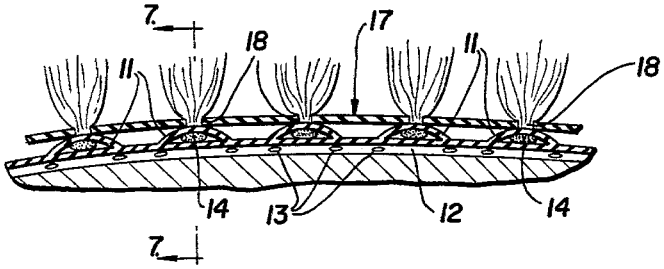
FIG. 6 is a vertical section through the wig taken longitudinally of a row of attachment loops and across the head.
Figure 7:
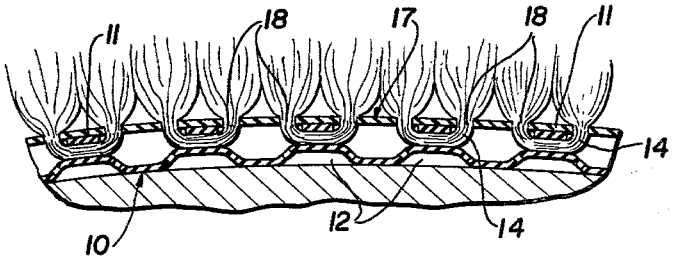
FIG. 7 is a vertical section taken on line 7—7 of FIG. 6.

The wig additionally comprises an exterior thin walled rubber or rubber-like cap 17 also molded to the shape of the skull and adapted to be applied snugly over the interior cap 10. The exterior cap is provided over its entire area with a multiplicity of small closely spaced apertures 18 through which sections of hair from the strands or pieces 14 are inserted so as to extend outwardly of the cap 17 to simulate the natural hair on the head, as illustrated in FIGS. 6 and 7. With the hair thus arranged outwardly of the cap 17, and covering the entire exterior thereof, it may be brushed and combed, parted and otherwise styled to meet the desires of the wearer. Both caps 10 and 17 will remain snugly secure to the head and will not become dislodged in severe wind, in the shower, or even during swimming. It requires deliberate peeling of the wig away from the scalp to accomplish its removal.

As best shown in FIG. 8, the marginal edge of the exterior rubber cap 17 defining a fine tapered hair line 19 extends somewhat outwardly of the corresponding marginal edge 20 of the interior cap so as to provide what might be termed an "envelope effect" between the two superposed caps. This arrangement enhances the security of the wig on the head and also enhances its trim, natural appearance. The ventilating air can circulate through the apertures 18 and hair to the apertures 13 and the ventilating channels 12 of the interior cap. This contributes greatly to the comfort of the wearer.

As illustrated in FIG. 1, the wig closely simulates a natural full head of hair which may be styled to the wishes of the wearer and also provides a fine natural-looking hair line. The wig avoids the heavy unnatural look of many present day wigs and forms a substantial improvement over the known prior art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A wig comprising an interior cap adapted to snugly fit the head and having a multiplicity of spaced hair strand attaching loops thereon, a multiplicity of hair strands attached to said loops and projecting outwardly therefrom, and an exterior cap adapted to fit snugly over the interior cap and having a multiplicity of apertures formed therethrough, and said apertures receiving sections of hair in said hair strands whereby the sections of hair extend outwardly of the exterior cap to form a substantially continuous hair covering for the exterior of the wig closely simulating natural hair.

2. A wig as defined in claim 1, and said loops of the interior cap being arranged in discrete rows, the interior cap having scalp ventilating channels beneath said rows, the interior cap also having scalp ventilating apertures on opposite sides of said rows and channels communicating directly with said channels.

3. A wig as defined in claim 2, and said interior and exterior caps being formed from elastic material and stretchable into snug-fitting relationship with the scalp.

4. A wig as defined in claim 1, and said interior and exterior caps formed of elastic material.

5. A wig as defined in claim 1, and said attaching loops rising from the surface of the interior cap and being arched, said hair strands comprising individual bundles of hairs tied in assembled relationship substantially midway between their ends, each strand being insertable beneath one attaching loop so that each strand can projecting substantially equidistantly beyond the loop on opposite sides thereof, and a tie element anchoring each strand to one of said loops.

6. A wig as defined in claim 5, and the hairs of each strand being extended outwardly through more than one adjacent aperture of the exterior cap so that said hair covering is rendered continuous in appearance on the wig.

7. A wig as defined in claim 1, and the marginal edge of the exterior cap extending outwardly of the marginal edge of the interior cap around the entire margin of the wig so as to provide on the wig a fine continuous natural-looking tapered hair line.

* * * * *